US010125729B1

(12) United States Patent
Mashburn

(10) Patent No.: US 10,125,729 B1
(45) Date of Patent: Nov. 13, 2018

(54) THROTTLE BODY ADAPTER FOR MARINE ENGINE AIR INTAKE

(71) Applicant: Indmar Products Company Inc., Millington, TN (US)

(72) Inventor: Rachel M. Mashburn, Apopka, FL (US)

(73) Assignee: Indmar Products Company Inc., Millington, TN (US)

( * ) Notice: Subject to any disclaimer, the term of this patent is extended or adjusted under 35 U.S.C. 154(b) by 0 days.

(21) Appl. No.: 15/697,889

(22) Filed: Sep. 7, 2017

(51) Int. Cl.

| | |
|---|---|
| ***F02M 35/16*** | (2006.01) |
| ***F02M 35/10*** | (2006.01) |
| ***F02M 35/12*** | (2006.01) |
| ***F02D 9/10*** | (2006.01) |

(52) U.S. Cl.
CPC ..... *F02M 35/165* (2013.01); *F02D 9/1035* (2013.01); *F02M 35/10032* (2013.01); *F02M 35/1205* (2013.01); *F02M 35/10085* (2013.01)

(58) Field of Classification Search
CPC ..... F02M 35/16; F02M 35/165; F02M 35/10032; F02M 35/1205; F02M 35/10085; F02D 9/1035
See application file for complete search history.

(56) References Cited

U.S. PATENT DOCUMENTS

| | | | | |
|---|---|---|---|---|
| 4,829,942 | A * | 5/1989 | Ampferer | F02M 35/10072 123/184.37 |
| 5,353,767 | A * | 10/1994 | Carbone | F02M 35/10052 123/184.47 |
| 6,602,099 | B1 | 8/2003 | Loberger et al. | |
| 6,863,044 | B2 * | 3/2005 | Nakamura | F02M 35/024 123/198 E |
| 6,959,915 | B1 | 11/2005 | Wald et al. | |
| 7,363,908 | B2 | 4/2008 | Chida et al. | |

OTHER PUBLICATIONS

"Throttle Body Injection Versus Multi Port Injection: Comparing the Performance of Carbureors Versus TBI and Port Fuel Injection", Marine Engine Digest, 2 pp., http://www.marineenginedirest.com/special-reports/throttle-body-versus-multiport-fuel-injection.htm.

* cited by examiner

*Primary Examiner* — Hieu T Vo
(74) *Attorney, Agent, or Firm* — Wood, Herron & Evans, LLP

(57) ABSTRACT

A throttle body adapter connects a throttle body and an air intake manifold spaced from the throttle body in a marine engine. The throttle body adapter has an air passage having an inlet and an outlet of different shapes. The throttle body adapter has threaded openings which allow a fuse box, an electronic control module, a hose fitting and a mounting bracket for a beauty cover to be mounted to the throttle body adapter with threaded fasteners. The throttle body adapter further comprises a threaded opening adapted to receive an air inlet temperature sensor.

20 Claims, 8 Drawing Sheets

THROTTLE BODY ADAPTER FOR MARINE ENGINE AIR INTAKE

TECHNICAL FIELD

The present invention relates generally to marine engines and, more particularly, to an air intake throttle body adapter for a marine engine.

BACKGROUND

Air intake systems for marine engines generally include multiple components. One of such components is an air intake throttle body to control the amount of air passing into an intake manifold. In conventional air intake systems, the throttle body is spaced from the air intake manifold and the two must be connected.

Such connection heretofore has required multiple pieces. One disadvantage of such a connection is the possibility that parts become damaged or separate from each other.

Accordingly, there is a need for an improved throttle body adapter for connecting a throttle body to an air intake manifold in a marine engine to address these and other shortcomings.

SUMMARY OF THE INVENTION

According to an exemplary embodiment of the invention, a throttle body adapter connects a throttle body to an air intake manifold of a marine engine. In one preferred embodiment, the throttle body is upstream of the air intake manifold. The throttle body adapter comprises a unitary body extending between the throttle body and the air intake manifold. The unitary body has an air passage extending through the unitary body to allow air to pass from the throttle body to a downstream air intake manifold opening. The air passage has a generally circular inlet and a generally rectangular outlet in one embodiment.

The unitary body has threaded inlet openings at an upstream end adapted to receive threaded fasteners for securing the throttle body adapter and the throttle body together. At its downstream end, the unitary body has threaded outlet openings adapted to receive threaded fasteners for securing the throttle body adapter to a portion of the intake manifold.

In addition, the unitary body has threaded openings on a first side adapted to receive threaded fasteners for securing a fuse box to the unitary body and a hollow portion on a second side. The hollow portion has threaded corner openings adapted to receive threaded fasteners for securing an electronic control module to the throttle body adapter. In order to mount a bracket for a beauty cover, the unitary body has additional threaded openings on the top of the throttle body adapter. More threaded openings are incorporated into the unitary body to receive a hose fitting and an air inlet temperature sensor.

According to another aspect of the invention, a throttle body adapter extends between a throttle body and an air intake manifold of a marine engine. In one preferred embodiment, the throttle body is upstream of the air intake manifold. The throttle body adapter is a single member comprising a unitary body having an air passage extending through the unitary body to allow air to pass from the throttle body to a downstream air intake manifold opening. The air passage has a generally circular inlet and a generally rectangular outlet in one embodiment.

The unitary body has threaded inlet openings spaced around the generally circular inlet of the air passage adapted to receive threaded fasteners for securing the throttle body adapter and the throttle body together. At its downstream end, the unitary body has threaded outlet openings adapted to receive threaded fasteners for securing the throttle body adapter to a portion of the intake manifold.

In addition, the unitary body has threaded side openings on a first side adapted to receive threaded fasteners for securing a fuse box to the unitary body and a hollow portion on a second side. The hollow portion has threaded corner openings adapted to receive threaded fasteners for securing an electronic control module to the throttle body adapter.

In order to mount a bracket for a beauty cover, the unitary body has additional threaded openings on the top of the throttle body adapter. More threaded openings are incorporated into the unitary body to receive a hose fitting and an air inlet temperature sensor.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The drawings, which are incorporated in and constitute a part of this specification, illustrate embodiments of the invention and, together with the general description given above and the detailed description given below, serve to explain the embodiments of the invention.

DETAILED DESCRIPTION OF THE DRAWINGS

Figure 1:
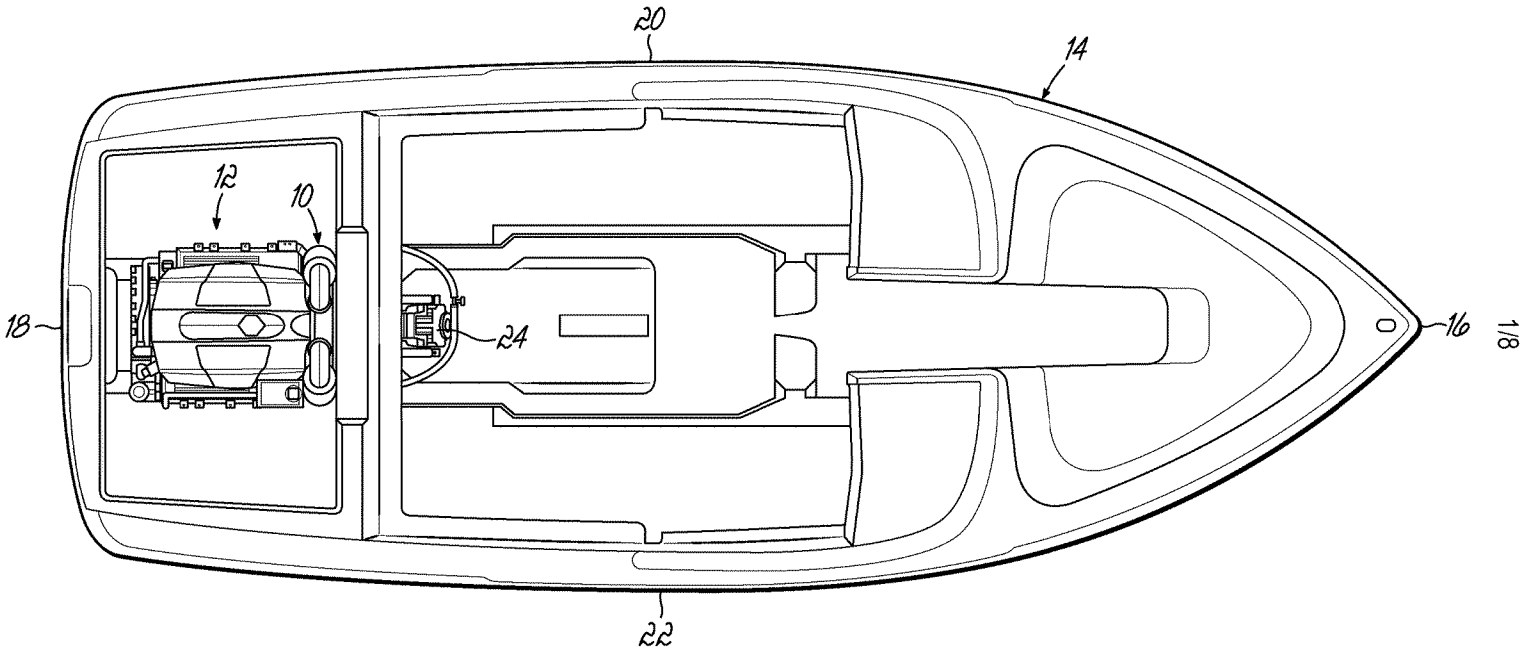
FIG. 1 is a top view of a motorboat including an inboard engine having an air intake system including a throttle body adapter, in accordance with the invention.

Referring to FIG. 1, an air intake system 10, according to an exemplary embodiment of the invention, is shown mounted to a marine engine 12 within a motorboat 14. The motorboat 14 includes a bow 16, a stern 18, a port side 20, and a starboard side 22. The engine 12 is shown mounted in an "inboard" configuration and is coupled to a V-drive transmission 24 that drives a propeller shaft and propeller (not shown) to rotate, which propels the motorboat 14 through the water.

Figure 2:
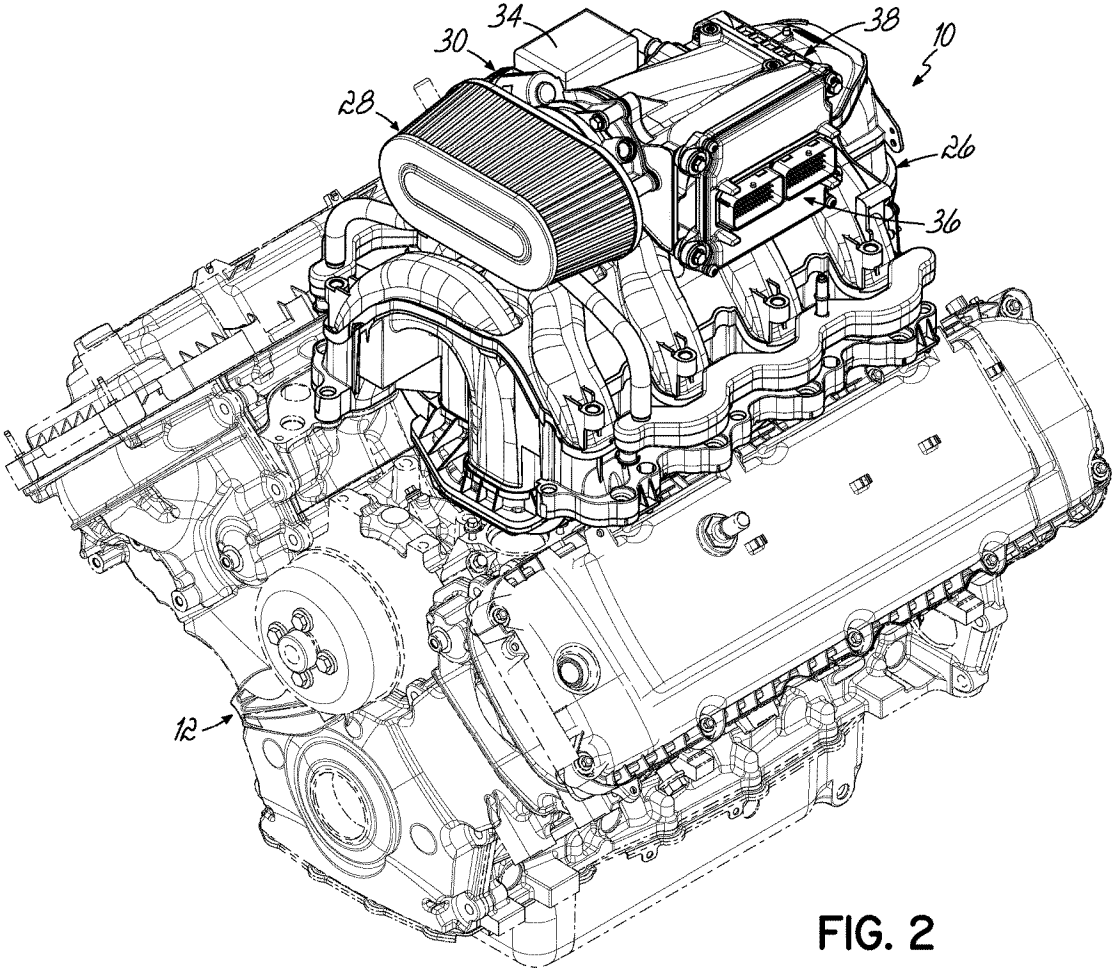
FIG. 2 is a perspective view of a marine engine air intake system according to an exemplary embodiment of the invention.
Figure 3:
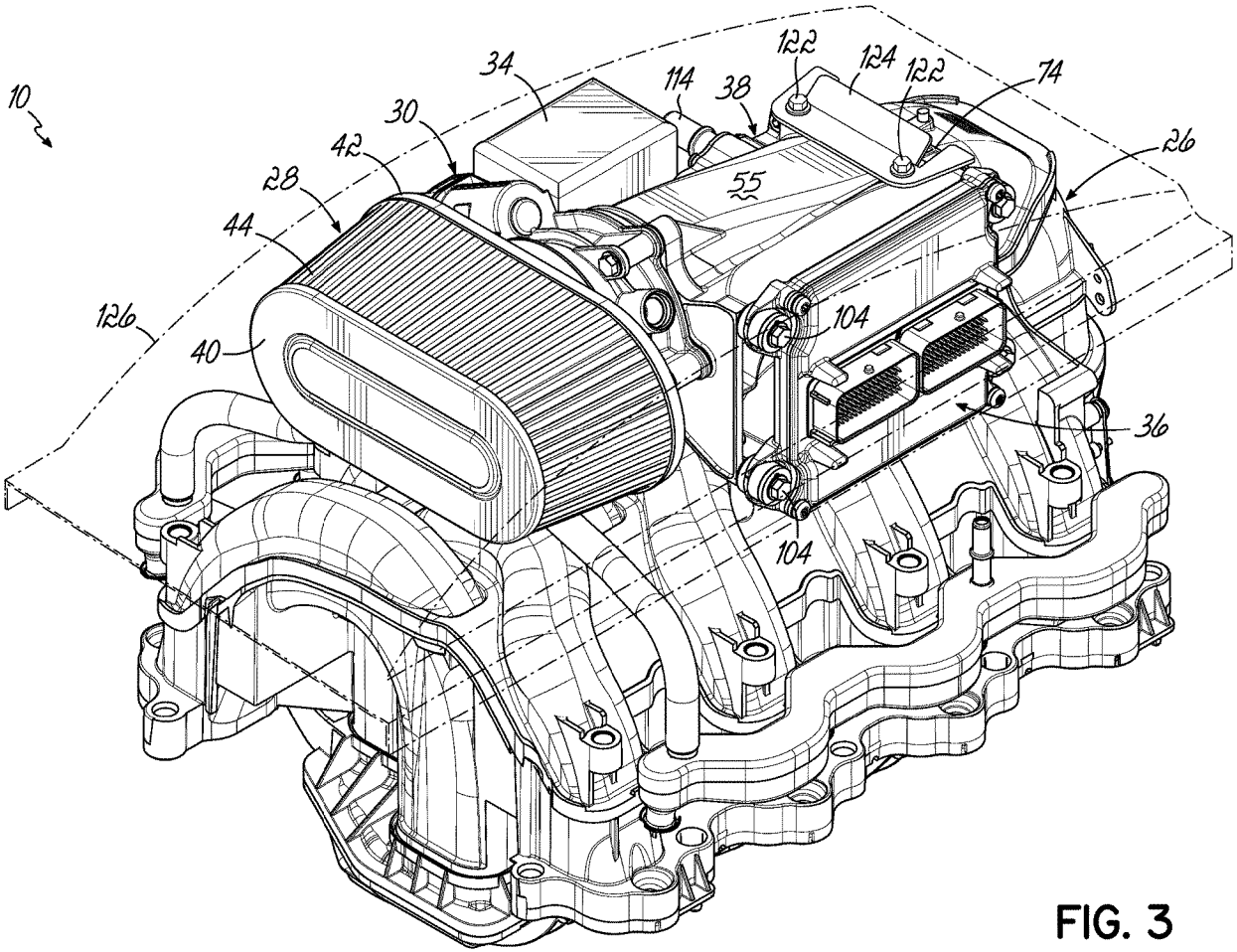
FIG. 3 is an enlarged view of the marine engine air intake system of FIG. 3.

Referring to FIG. 2, the exemplary air intake system 10 is shown in greater detail, with the engine 12 being shown in dashed lines. FIG. 3 shows a closer view of air intake system 10 which generally includes an air intake manifold 26 which distributes air to all cylinders (not shown) of the engine 12, an air filter assembly 28, a throttle body 30 having an adjustable throttle plate 32 therein (see FIG. 4), a fuse box 34, an electronic control module 36 and a throttle body adapter 38.

Figure 5:
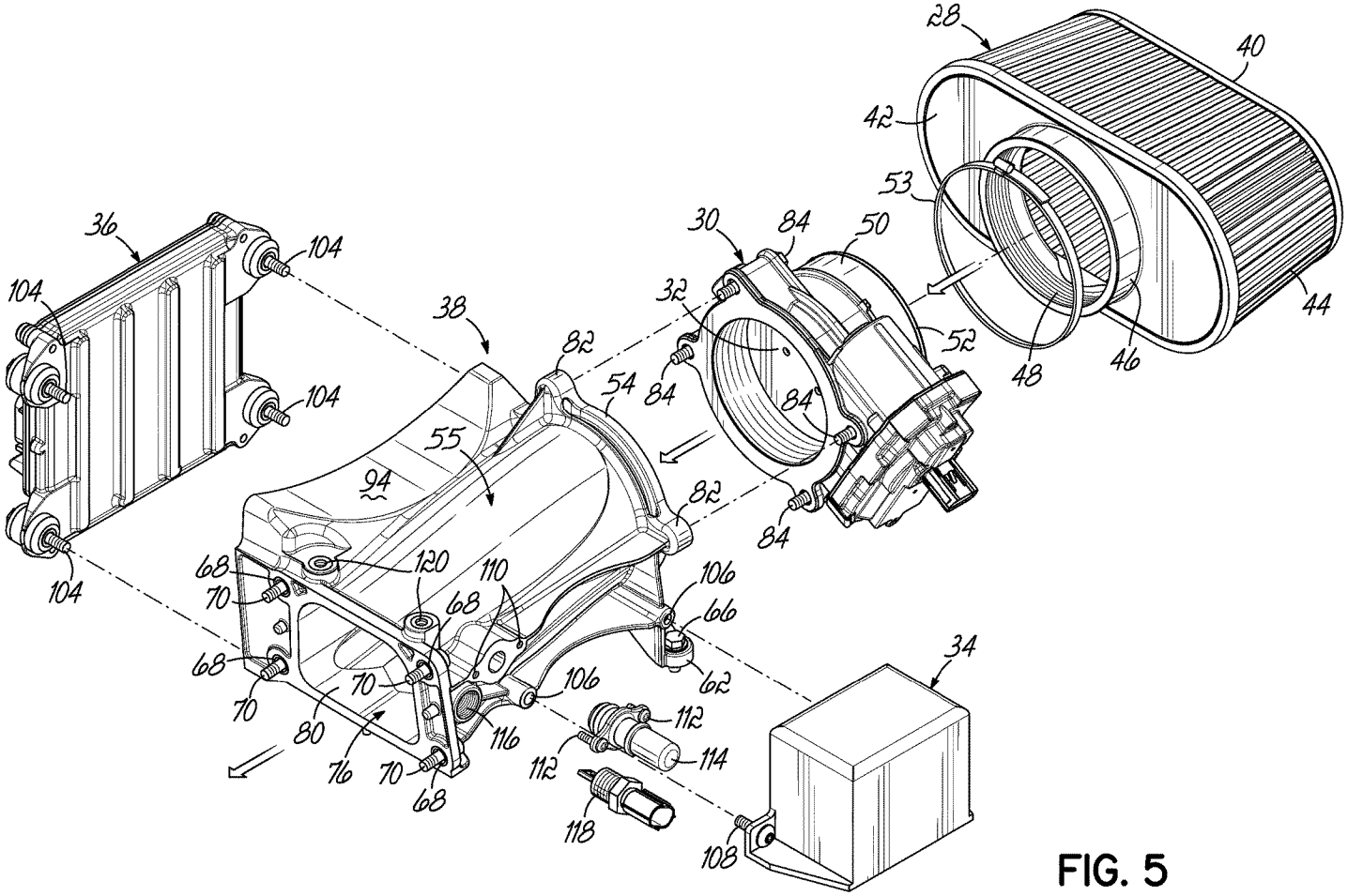
FIG. 5 is a partially disassembled view of the marine engine air intake system of FIG. 3, showing components of the system.

Moving generally from upstream downstream along the air intake system 10, the air filter assembly 28 is illustrated having an upstream cover plate 40, a downstream cover plate 42 and air filter 44 therebetween. As best shown in FIG. 5, the downstream cover plate 42 has a ring 46 having internal ribs 48 on the interior surface of the ring 46.

As shown in FIG. 5, the throttle body 30 has an upstream ring 50 which has an external bead 52 which fits between adjacent internal ribs 48 of the ring 46 of downstream cover plate 42 of air filter assembly 28 to join the throttle body 30 and the air filter assembly 28. A clamp 53 is used to further secure the ring 46 of the downstream cover plate 42 of air filter assembly 28 over the upstream ring 50 of the throttle body 30.

Figure 6A:
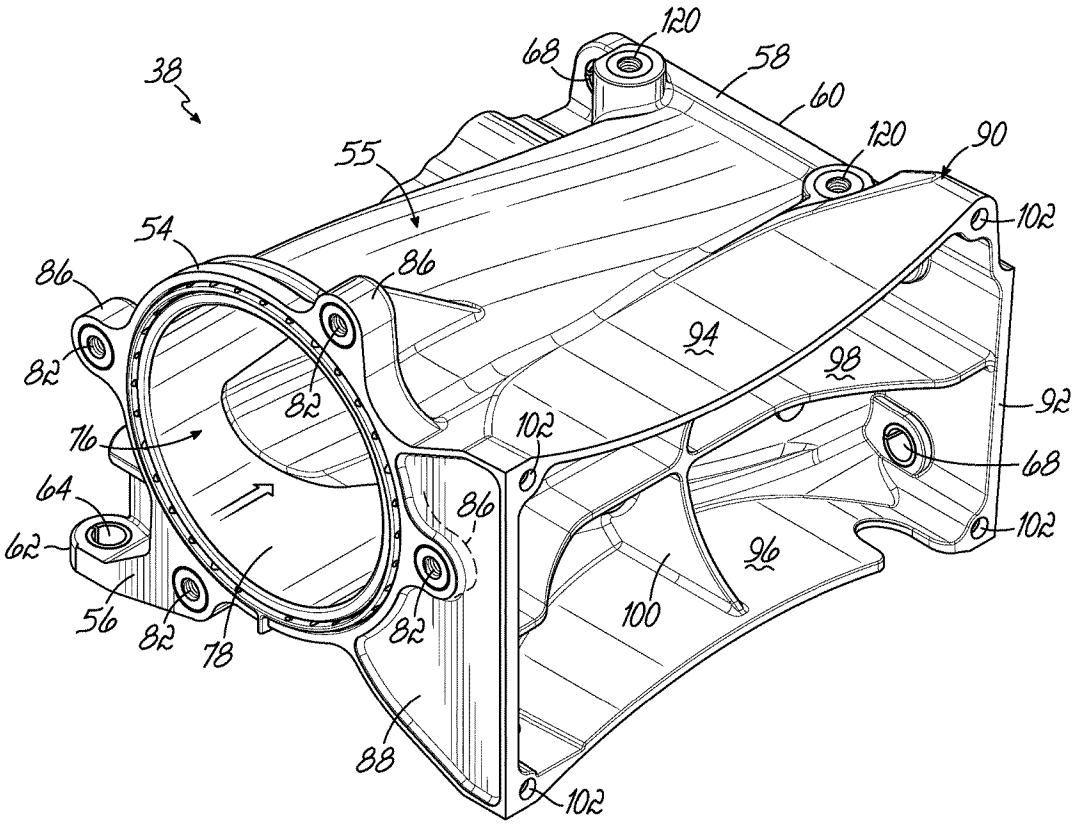
FIG. 6A is a front perspective view of the throttle body adapter of the present invention.
Figure 6B:
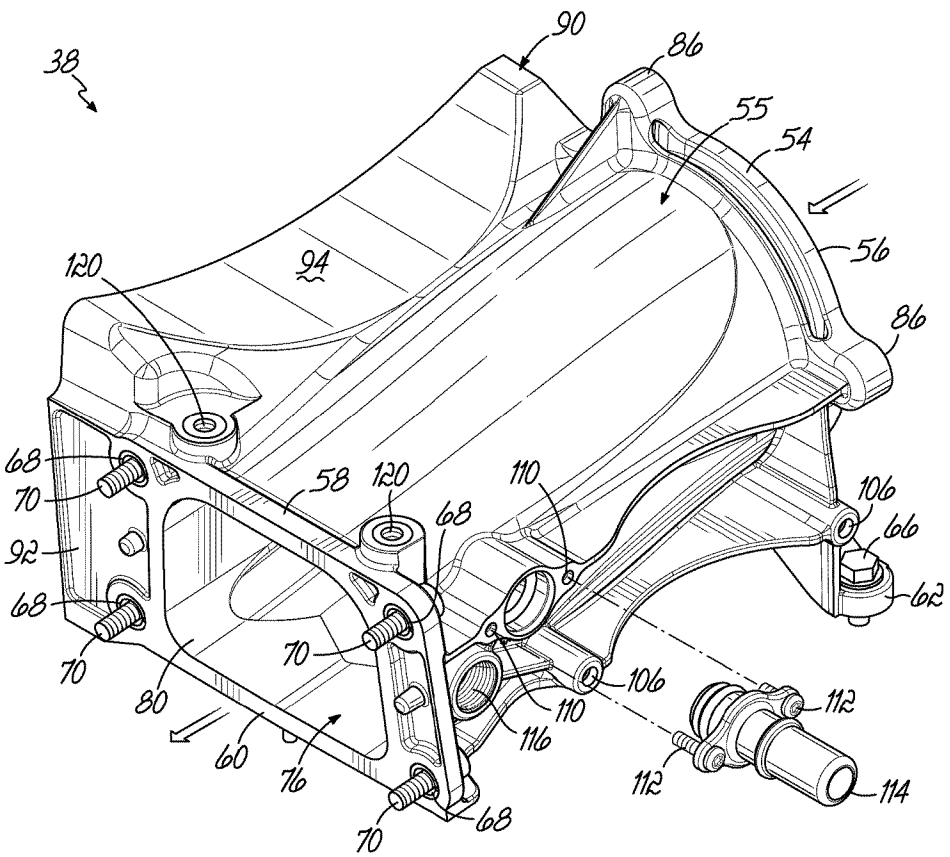
FIG. 6B is a rear perspective view of the throttle body adapter of the present invention.
Figure 7:
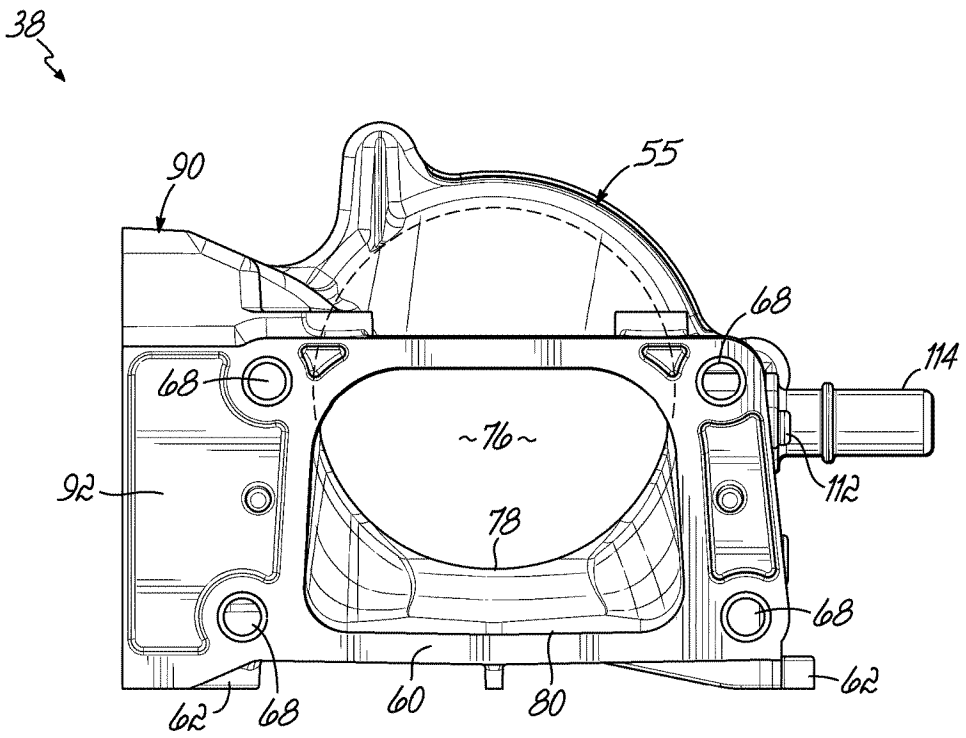
FIG. 7 is a rear elevational view of the throttle body adapter of the present invention.

The throttle body adapter 38, the focus of the present invention, is downstream of the throttle body 30. The throttle body adapter 38 allows for a lower mounting of the throttle body 30 to reduce the overall size of the engine package. As best shown in FIGS. 6A, 6B and 7, throttle body adapter 38 has injection molded plastic unitary body 55. The plastic in one embodiment is glass filled nylon. The throttle body adapter 38 has a front portion 54 having a generally planar upstream surface 56 best shown in FIG. 6A and a rear portion 58 having a generally planar downstream surface 60, best shown in FIG. 6B.

The throttle body adapter 38 is secured to the air intake manifold 26 at five locations, one in the front of the throttle body adapter 38 and four at the rear of the throttle body adapter 38. As best shown in FIG. 6A, the front portion 54 of the throttle body adapter 38 includes a mounting finger 62 having an opening 64 therethrough for receiving a fastener 66 (see FIG. 4) which fits into an opening (not shown) in the air intake manifold 26. Fastener 66 stabilizes the front portion 54 of the throttle body adapter 38 relative to the air intake manifold 26.

As best shown in FIGS. 5, 6B and 7, the rear portion 58 of the throttle body adapter 38 has four outlet openings 68 therethrough, each for receiving a fastener 70 which fits into an opening 72 (see FIG. 4) in an intake portion 74 of the air intake manifold 26. Fasteners 70 stabilize the rear portion 58 of the throttle body adapter 38 relative to the air intake manifold 26.

As best shown in FIG. 7, the throttle body adapter 38 has an air passage 76 extending through the unitary body 55. The air passage 76 comprises an air intake 78 and an air outlet 80. The air intake 78 is illustrated as being generally circular, but may be another configuration to match the shape of the outlet of the throttle body. The air outlet 80 is illustrated as being generally rectangular, but may be another configuration to match the shape of the inlet to the intake manifold.

Figure 4:
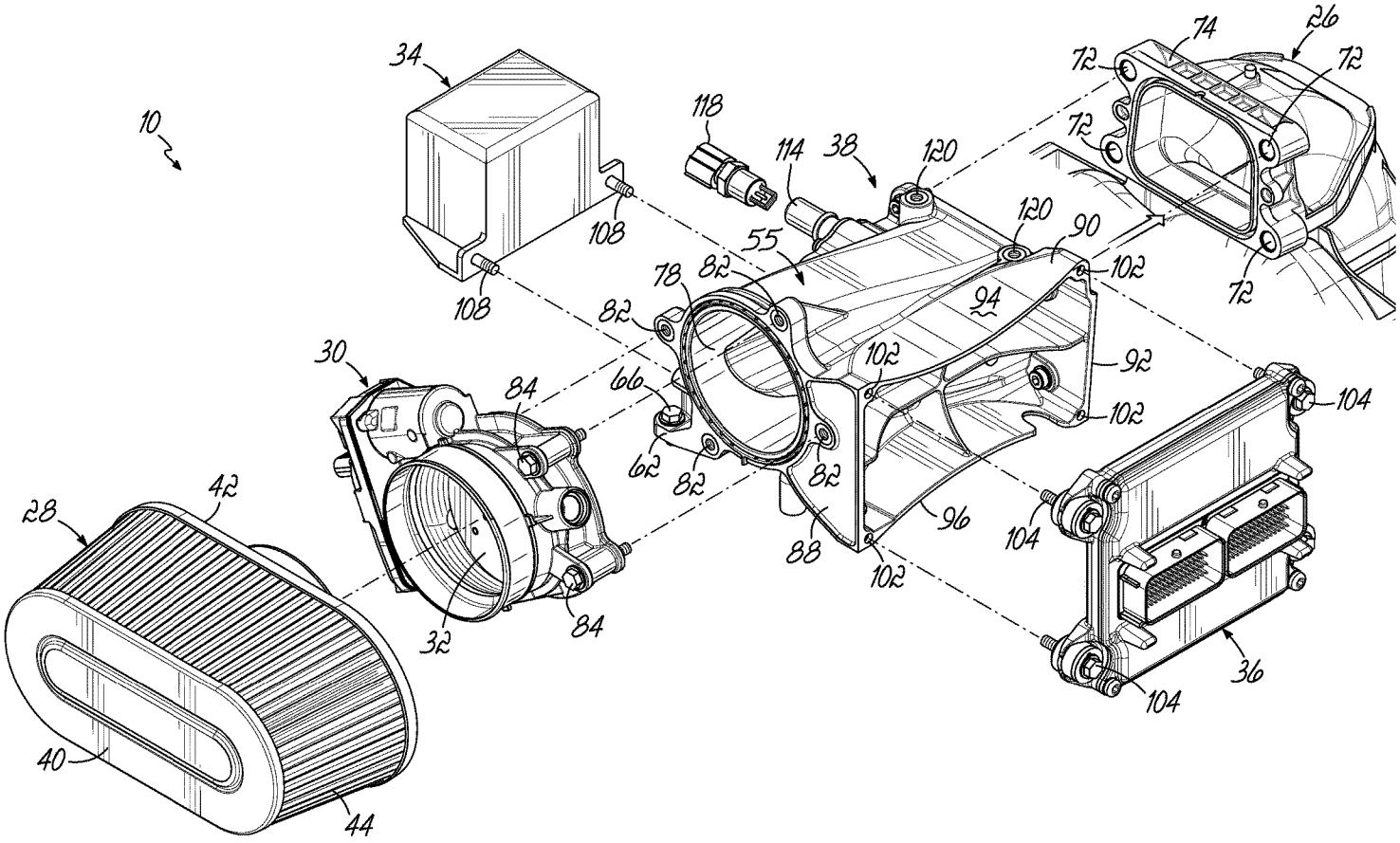
FIG. 4 is a partially disassembled view of the marine engine air intake system of FIG. 3, showing components of the system.

As best shown in FIGS. 4 and 6A, the throttle body adapter 38 has four threaded inlet openings 82 spaced around the generally circular air intake 78 of air passage 76. Each of the threaded openings 82 is adapted to receive a threaded fastener 84 extending through the throttle body 30, as shown in FIG. 4, to secure the throttle body 30 and throttle body adapter 38 together. As best shown in FIG. 6A, each of the four threaded openings 82 extend through fingers 86 which form part of the front portion 54 of the throttle body adapter 38.

As best shown in FIG. 6A, throttle body adapter 38 has an integral hollow portion 90 on one side thereof. The hollow portion 90 of the throttle body adapter 38 has a front wall 88, a rear wall 92, a bowed or curved top wall 94 and a bowed or curved bottom wall 96. The top wall 94 bows towards the bottom wall 96, and the bottom wall 96 bows towards the top wall 94. The hollow portion 90 of the throttle body adapter 38 further comprises intersecting first and second strengthening walls 98, 100. The first strengthening wall 98 extends between the front and rear walls 88, 92, respectively, of the hollow portion 90 of the throttle body adapter 38. The second strengthening wall 100 extends between the top and bottom walls 94, 96, respectively, of the hollow portion 90 of the throttle body adapter 38.

At each corner of the hollow portion 90 of the throttle body adapter 38 is a threaded opening 102 adapted to receive a threaded fastener 104 extending through the electronic control module 36 to secure the electronic control module 36 to the throttle body adapter 38.

As best shown in FIG. 6B, throttle body adapter 38 has on the side opposite the hollow portion 90, two threaded openings 106 adapted to receive threaded fasteners 108 (only one being shown in FIG. 5) extending through fuse box 34 to secure the fuse box 34 to the throttle body adapter 38. On the same side of the throttle body adapter 38 as the fuse box 34 are two spaced threaded openings 110 adapted to receive threaded fasteners 112 extending through a hose fitting 114 to secure the hose fitting 114 to the throttle body adapter 38. Below the threaded openings 110 on the same side of the throttle body adapter 38 is a threaded opening 116 adapted to receive an air inlet temperature sensor 118.

As best shown in FIGS. 4, 6A and 6B, throttle body adapter 38 has on its top two threaded openings 120 adapted to receive threaded fasteners 122 (shown in FIG. 3) to secure a mounting bracket 124 to the throttle body adapter 38. The mounting bracket 124 is used to secure an engine top or beauty cover 126 to the throttle body adapter 38 of the air intake system 10 shown in dashed lines in FIG. 3.

Although one configuration of fuse box 34 is illustrated, the drawings are not intended to be limiting. Other configurations of fuse boxes may be used. The throttle body adapter 38 of the invention eliminates the need to use a bracket to secure a fuse box to the engine.

Although one configuration of electronic control module 36 is illustrated, the drawings are not intended to be limiting. Other configurations of electronic control modules may be used. The throttle body adapter 38 of the invention eliminates the need to use a bracket to secure an electronic control module to the engine.

Although one configuration of mounting bracket for an engine top or beauty cover is illustrated, the drawings are not intended to be limiting. Other configurations of engine covers may be used.

Although one configuration of throttle body 32 is illustrated, the drawings are not intended to be limiting. Other configurations of throttle bodies may be used.

An advantage of the present invention is that one or more sensors, such as the air intake temperature sensor, may be mounted to the throttle body adapter 38 without requiring additional elements, such as mounting brackets. Another advantage of the present invention is that noise may be reduced between the engine out the throttle body. Another advantage of the throttle body adapter 38 is that a positive crankcase ventilation system may be efficiently connected to the engine.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A throttle body adapter for connecting a throttle body to an air intake manifold of a marine engine, said throttle body adapter comprising:

a unitary body extending between the throttle body and the air intake manifold, the unitary body having an air passage extending through the unitary body, the unitary body having threaded inlet openings adapted to receive threaded fasteners for securing the throttle body adapter to the throttle body, the unitary body having threaded outlet openings adapted to receive threaded fasteners for securing the throttle body adapter to the intake manifold, the unitary body having threaded openings on a first side of the unitary body adapted to receive threaded fasteners for securing a fuse box to the unitary body and a hollow portion on a second side of the unitary body, the hollow portion having threaded corner openings adapted to receive threaded fasteners for securing an electronic control module to the throttle body adapter.

2. The throttle body adapter of claim 1, wherein the air passage has a generally circular inlet.

3. The throttle body adapter of claim 1, wherein the air passage has a generally rectangular outlet.

4. The throttle body adapter of claim 1, wherein the unitary body has additional threaded openings on an upper surface therefor for securing a beauty cover mounting bracket to the unitary body with threaded fasteners.

5. The throttle body adapter of claim 1, wherein the threaded inlet openings are spaced around an inlet of the air passage.

6. The throttle body adapter of claim 1, wherein the unitary body has a threaded opening for receiving an air inlet temperature sensor.

7. The throttle body adapter of claim 1, wherein the threaded outlet openings are spaced around the outlet of the air passage.

8. The throttle body adapter of claim 1, wherein the unitary body has additional threaded openings for receiving a hose fitting.

9. A throttle body adapter extending between a throttle body and an air intake manifold of a marine engine, said throttle body adapter comprising:

a unitary body having an air passage extending through the unitary body, the air passage having a generally circular inlet and a generally rectangular outlet, the unitary body having threaded inlet openings adapted to receive threaded fasteners for securing the throttle body adapter to a throttle body and threaded outlet openings adapted to receive threaded fasteners for securing the throttle body adapter to an intake manifold, the unitary body having threaded side openings on a first side of the unitary body adapted to receive threaded fasteners for securing a fuse box to the unitary body and a hollow portion on a second side of the unitary body, the hollow portion having threaded corner openings adapted to receive threaded fasteners for securing an electronic control module to the throttle body adapter.

10. The throttle body adapter of claim 9, wherein the unitary body has additional threaded openings for receiving a hose fitting.

11. The throttle body adapter of claim 9, wherein the unitary body has a threaded opening for receiving an air inlet temperature sensor.

12. The throttle body adapter of claim 9, wherein the unitary body has additional threaded openings on an upper surface therefor for securing a beauty cover mounting bracket to the unitary body with threaded fasteners.

13. The throttle body adapter of claim 9, wherein the threaded inlet openings are spaced around the inlet of the air passage.

14. The throttle body adapter of claim 13, wherein the unitary body has four threaded inlet openings.

15. The throttle body adapter of claim 9, wherein the threaded outlet openings are spaced around the outlet of the air passage.

16. The throttle body adapter of claim 15, wherein the unitary body has four threaded outlet openings.

17. A throttle body adapter extending between a throttle body and an air intake manifold of a marine engine, said throttle body adapter comprising:

a unitary body having an air passage extending through the unitary body, the air passage having a generally circular inlet and a generally rectangular outlet, the unitary body having threaded inlet openings adapted to receive threaded fasteners for securing the throttle body to an upstream side of the throttle body adapter, the unitary body having threaded outlet openings adapted to receive threaded fasteners for securing the air intake manifold to a downstream side of the throttle body adapter, the unitary body having threaded side openings adapted to receive threaded fasteners for securing a fuse box and an electronic control module to the unitary body.

18. The throttle body adapter of claim 17, wherein the unitary body has a hollow portion having threaded corner openings adapted to receive threaded fasteners for securing the electronic control module to the throttle body adapter.

19. The throttle body adapter of claim 17, wherein the unitary body has additional threaded openings for securing a beauty cover mounting bracket to the unitary body with threaded fasteners.

20. The throttle body adapter of claim 17, wherein the unitary body has a threaded opening for receiving an air inlet temperature sensor.

* * * * *